US009047794B2

(12) United States Patent
Edmond et al.

(10) Patent No.: US 9,047,794 B2
(45) **Date of Patent: *Jun. 2, 2015**

(54) WINGTIP FIN OF AN AIRCRAFT

(71) Applicant: AIRBUS OPERATIONS LIMITED, Bristol (GB)

(72) Inventors: George Edmond, Yatton (GB); Robert R L Thompson, Bristol (GB)

(73) Assignee: AIRBUS OPERATIONS LIMITED, Bristol (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/687,077

(22) Filed: Nov. 28, 2012

(65) Prior Publication Data

US 2013/0139421 A1 Jun. 6, 2013

(30) Foreign Application Priority Data

Dec. 5, 2011 (GB) ..... 1120862.6

(51) Int. Cl.
*G09F 13/22* (2006.01)
*G09F 21/10* (2006.01)

(52) U.S. Cl.
CPC ..... *G09F 21/10* (2013.01)

(58) Field of Classification Search
USPC ..... 244/199.4, 3.24, 177 R, 91, 3.25; 40/212, 564–570, 572, 576; 362/470
See application file for complete search history.

(56) References Cited

U.S. PATENT DOCUMENTS

| | | | | |
|---|---|---|---|---|
| 1,521,779 | A | 1/1925 | Martin | |
| 1,695,078 | A | 12/1928 | Barker | |
| 2,052,288 | A | 8/1936 | Grady | |
| 2,571,158 | A * | 10/1951 | Orlansky | 362/470 |
| 5,456,032 | A * | 10/1995 | Matsumoto et al. | 40/636 |
| 5,522,540 | A * | 6/1996 | Surman | 232/17 |
| 5,671,997 | A * | 9/1997 | Potts | 362/84 |
| 5,758,947 | A * | 6/1998 | Glatt | 362/105 |
| 5,953,842 | A * | 9/1999 | Bodell | 40/570 |
| 6,069,596 | A * | 5/2000 | Marvin et al. | 345/52 |
| 6,105,297 | A * | 8/2000 | Inaba | 40/707 |
| 6,183,109 | B1 * | 2/2001 | Nelson et al. | 362/249.02 |
| 6,467,208 | B1 * | 10/2002 | Patterson | 40/570 |
| 6,497,600 | B1 * | 12/2002 | Levy et al. | 446/34 |
| 6,712,324 | B2 * | 3/2004 | Catteau et al. | 248/222.51 |
| 7,121,676 | B1 * | 10/2006 | Kutnyak | 362/105 |
| 7,624,951 | B1 * | 12/2009 | Kraft et al. | 244/199.4 |
| 7,826,206 | B2 * | 11/2010 | Woo | 361/679.05 |
| 7,889,329 | B2 * | 2/2011 | Petrich et al. | 356/39 |
| 7,900,877 | B1 * | 3/2011 | Guida | 244/199.4 |

(Continued)

OTHER PUBLICATIONS

Search Report corresponding to GB 1120862.6, dated Apr. 4, 2012.

*Primary Examiner* — Shin Kim

(74) *Attorney, Agent, or Firm* — Lowe Hauptman & Ham, LLP

(57) ABSTRACT

A wingtip fin of an aircraft comprising an upstanding fin body, the fin body having an inboard face and an outboard face, a sign assembly in the fin body, the assembly comprising a translucent, graphic bearing face, substantially flush with and forming at least part of the inboard face or the outboard face of the fin body, a recess in the fin body behind the graphic-bearing face, and a light source arranged in the recess to illuminate the graphic-bearing face from inside the fin body.

18 Claims, 3 Drawing Sheets

(56) References Cited

U.S. PATENT DOCUMENTS

| | | | | |
|---|---|---|---|---|
| 7,988,313 | B2 * | 8/2011 | Kutnyak | 362/106 |
| 8,506,138 | B2 * | 8/2013 | Edmond et al. | 362/470 |
| 2004/0107615 | A1 * | 6/2004 | Pare | 40/544 |
| 2006/0248761 | A1 * | 11/2006 | Cheung et al. | 40/564 |
| 2008/0142734 | A1 * | 6/2008 | Forsyth et al. | 250/492.1 |
| 2009/0237917 | A1 * | 9/2009 | Kutnyak | 362/106 |
| 2010/0091489 | A1 * | 4/2010 | Pearson et al. | 362/235 |
| 2011/0188257 | A1 | 8/2011 | Sidler | |

* cited by examiner

WINGTIP FIN OF AN AIRCRAFT

RELATED APPLICATIONS

The present application is based on, and claims priority from, British Application No. 1120862.6, filed Dec. 5, 2011, the disclosure of which is hereby incorporated by reference herein in its entirety.

The present invention relates to a wingtip fin of an aircraft particularly, although not exclusively limited to, a commercial passenger aircraft. The invention also relates to an illuminated sign assembly configured for use in a wingtip fin.

Various commercial passenger aircraft include upstanding fins at their wingtips. Such fins are included because it is believed that they reduce the wingtip vortex produced by the passage of such aircraft through the air. Commercial airlines have taken to using that surface to include, typically, corporate livery. Typically, that livery is applied by various means onto the surface of the fin, for example by the application of a decal. During low light or night conditions a dedicated remote light source illuminates the face of the fin which faces the fuselage to enable the livery to be viewed by passengers onboard the aircraft and by persons on the ground after the aircraft has landed.

It is object of the invention to provide an improved wingtip fin for an aircraft, particularly to provide a self-illuminating sign on one or both of the inner and outer faces of the wingtip.

According to a first aspect of the invention, there is provided a wingtip fin of an aircraft comprising an upstanding fin body extending from the tip of a wing, the fin body having an inboard face and an outboard face, a sign assembly in the fin body, the sign assembly comprising a translucent, graphic bearing face, substantially flush with and forming at least part of the inboard face or the outboard face of the fin body, a recess in the fin body behind the graphic bearing face and a light source arranged in the recess to illuminate the graphic bearing face from inside the fin body.

By illuminating the sign from within, the sign is always illuminated correctly, avoiding incorrect illumination due to wing movement or dislodging of the external lighting source.

A heat sink may be provided within the fin body to assist dissipation of heat from the light source.

The translucent graphic bearing face is preferably mounted to the rest of the sign assembly either by a mechanical fastener or a clip, an adhesive or integral moulding.

The light source preferably comprises an array of Light Emitting Diodes (LEDs) although other light sources such as fluorescent tubes may be used.

The light source preferably transmits low intensity light to reduce light pollution.

Where the light source comprises an array of LEDs, the LEDs may be arranged at predetermined angles and have predetermined input intensities to optimise the illumination of the image borne on the translucent graphic bearing face.

The sign assembly may include an umbilical cord electrical connection to facilitate external access, removal and/or replacement of the sign assembly. Alternatively, a bayonet contact, spring loaded contact or touch contact electrical connection may be provided.

An additional power cable may be provided for use as a backup or to provide additional lighting positioned independently from the light source in the wingtip fin.

The sign assembly preferably comprises a self-contained module comprising the translucent graphic bearing face and the light source. Such a module may be arranged replaceably in the wingtip fin.

The sign assembly may comprise a translucent graphic bearing face on one side and a translucent graphic bearing face on the other, opposite side with the light source arranged between the translucent graphic bearing faces. In that way, a self-illuminated sign is provided on both inboard and outboard faces of the wingtip fin body.

According to another aspect of the invention there is provided an illuminated sign assembly configured to be received within a recess in a wingtip fin of an aircraft, the sign assembly comprising a housing, the housing containing a light source, the light source being covered by a wall of the housing, the wall of the housing being translucent and being arranged to receive a sign, the housing including an electrical power input connector for connection to an aircraft electrical power cable for powering the light source.

FIG. 1 shows a perspective view of a wingtip fin of an aircraft.

FIGS. 2*a* and 2*b* show the wingtip fin of FIG. 1 in schematic form, FIG. 2*a* is a view looking aft from the front of an aircraft wing and FIG. 2*b* is a view looking outboard along an aircraft wing.

Figure 1:
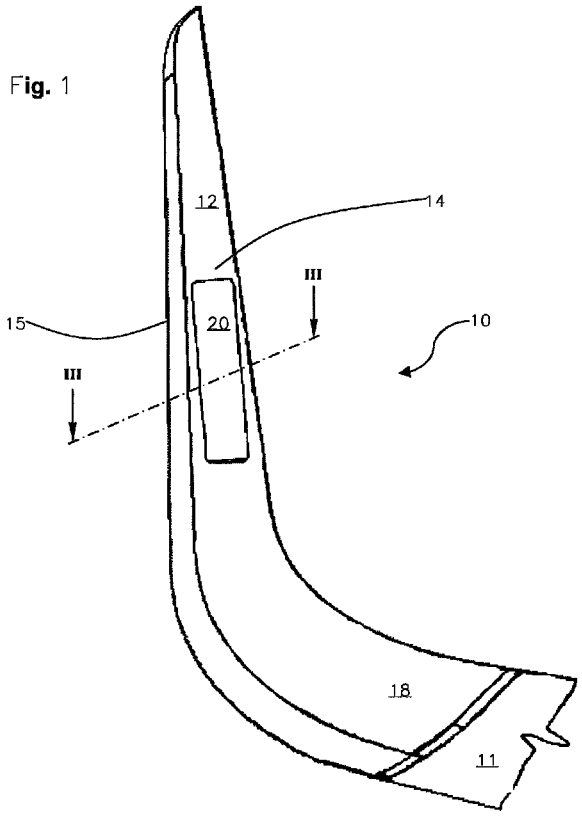

A wingtip fin 10 of an aircraft (see FIG. 1) has an aerodynamic form and approximates an L-shape, with a horizontal portion and a vertical portion. The vertical portion comprises an upstanding fin body 12 and the horizontal portion comprises an attachment region 18, which attaches to the outboard end of a wing 11. The upstanding fin body 12 further comprises a inboard face 14 and an outboard face 15.

Aligned vertically and horizontally to the approximate centre of the upstanding fin body 12 there is a sign assembly 20.

Figure 2A:
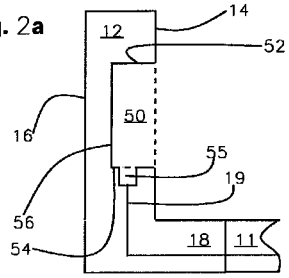
Figure 2B:
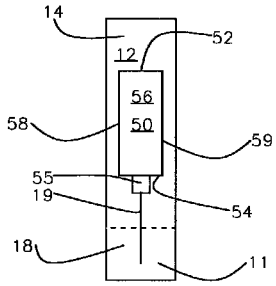

FIGS. 2*a* and 2*b* show the wingtip fin 10 and the wing 11 of FIG. 1 in a simplified view not featuring the sign assembly 20.

The upstanding fin body 12 features five internal walls, three of which can be seen in FIG. 2*a,* namely spaced apart parallel upper and lower walls 52 and 54, and outboard wall 56. The other two internal walls can be seen in FIG. 2*b,* namely spaced apart parallel fore and aft walls 58 and 59. These five internal walls bound a recess 50 in the upstanding fin body 12. The recess 50 is configured to receive the sign assembly 20 as described in more detail below. The lower wall 54 features a socket 55 connected to a power cable 19, which runs from the socket 55, down through the upstanding fin body 12, across the attachment region 18 and into the wing 11.

Figure 3:
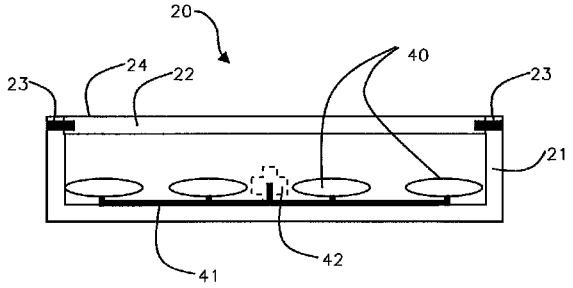
FIG. 3 is a schematic sectional view of a sign assembly for the wingtip of FIG. 1.

The sign assembly 20 in FIG. 3 comprises a housing 21, in the form of a rectangular case open at one face. A translucent, graphic bearing face 22 covers the open face of the housing 21 and is mounted to the housing 21 by screws 23, allowing removal and replacement of the face 22. The graphic bearing face 22 has an outward surface 24.

Four arrays 40 of light emitting diodes (LEDs), preferably multi-colour LEDs, are mounted within the housing 21 and are arranged to illuminate the translucent, graphic bearing face 22 from within the housing. The LED arrays 40 are connected to an electrical power supply line 41 within the housing 21 which, in turn, is connected to a power input connector 42 on the exterior of the housing 21 through lower wall 55. The power input connector 42 is a bayonet-type connector, ensuring a secure electrical connection with an electrical power cable from the aircraft (not shown).

Figure 4:
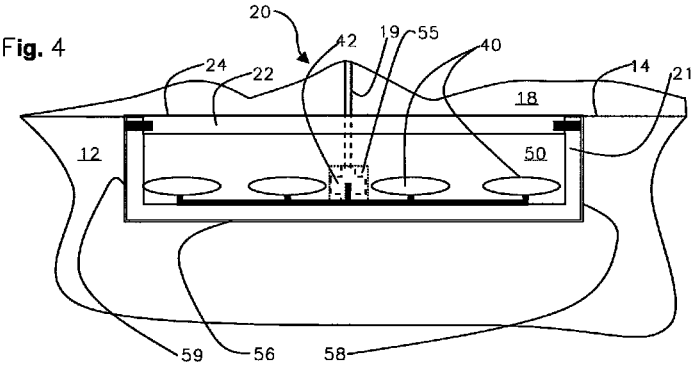
FIG. 4 shows a section view III-III of the wingtip of FIG. 1 in accordance with a first embodiment of the present invention.

FIG. 4 is a section through the upstanding fin body 12 of the wingtip fin 10 of FIG. 1, looking downwardly from above the wingtip. The section is taken approximately at line III-III in FIG. 1. The upstanding fin body 12 has recess 50, bounded by internal walls 52, 54, 56, 58 and 59 as described above. The sign assembly 20 is arranged within the recess 50 and is retained on five sides by the internal walls 52, 54, 56, 58 and 59 of the upstanding fin body, and on its sixth by the translucent graphic bearing face 22. The outward facing surface 24 of the translucent graphic bearing face 22 is arranged to sit flush with the inboard surface 14 of the upstanding fin body 12 to preserve the aerodynamic performance of the wingtip. The power input connector 42, is arranged to mate with the socket 55 so that electrical power can be delivered from the cable 19 in the aircraft wing 11, to the sign assembly 20.

Figure 5:
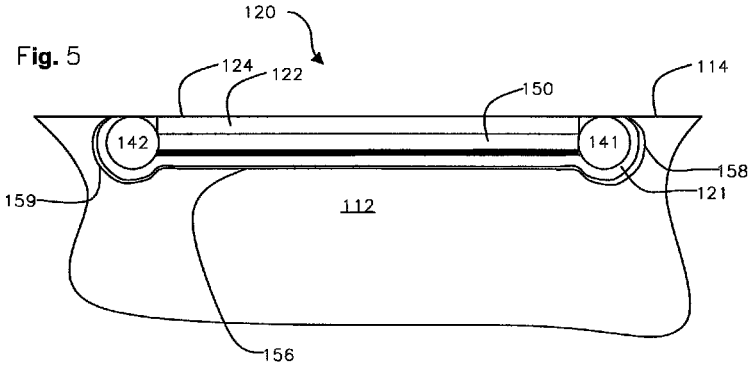
FIG. 5 shows a section view III-III of the wingtip of FIG. 1 in accordance with a second embodiment of the present invention.
Figure 6:
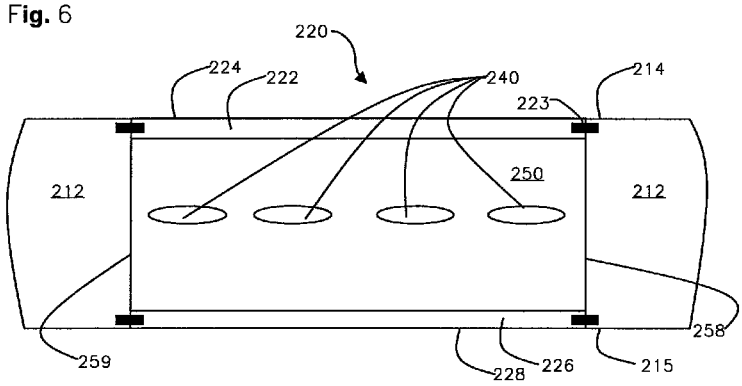
FIG. 6 shows a section view III-III of the wingtip of FIG. 1 in accordance with a third embodiment of the present invention.
Figure 7:
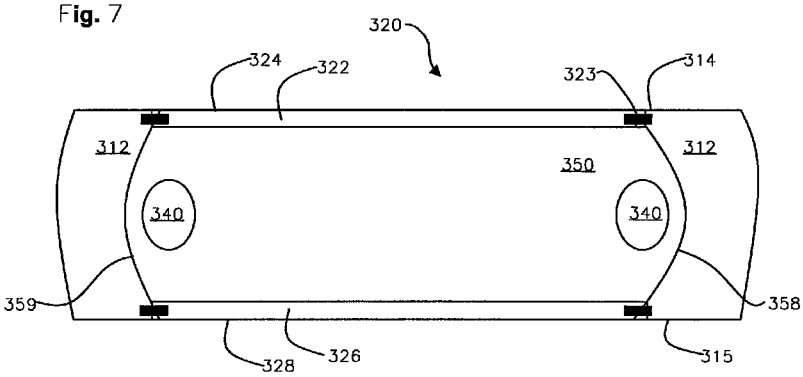
FIG. 7 shows a section view III-III of the wingtip of FIG. 1 in accordance with a third embodiment of the present invention.

FIGS. 5, 6 and 7 show the second, third and fourth embodiments in accordance with the present invention, which are substantially similar to that shown in FIG. 4 Similar features have been assigned the same numbers, prefixed by "1" to identify those features comprising the second embodiment and prefixed by a "2" to identify those features comprising the third embodiment and prefixed by a "3" to identify those features comprising the fourth embodiment.

FIG. 5 is a section through the upstanding fin body 12 of the wingtip fin 10 of FIG. 1, looking downwardly from above the wingtip. The section is taken approximately at line III-III in FIG. 1 in a similar fashion to FIG. 4. However, unlike FIG. 4 there are provided only two arrays of LEDs 141 and 142, which are located at the fore and aft limits of the sign assembly 120, with the first LED array 141 adjacent to the fore internal wall 158 and the second LED array 142 adjacent to the aft internal wall 159 of the upstanding fin body 112. Given the shape, size and location of these LED arrays 141, 142, the fore and aft internal walls 158, 159, are no longer parallel as in the embodiment of FIG. 4 but in fact crescent shaped, opposing each other such that they are able to surround the respective light sources 141, 142. The power input connection arrangement is not shown, but, is similar to that of the previous embodiment. The inner faces of the walls 158, 159 are reflective to reflect light from the arrays 141, 142 out through the graphic bearing face 122.

FIG. 6 is a section through the upstanding fin body 12 of the wingtip fin 10 of FIG. 1, looking downwardly from above the wingtip. The section is taken approximately at line III-III in FIG. 1 in a similar fashion to FIGS. 4 and 5. However, in this embodiment the upstanding fin body 212 has four internal walls, an upper internal wall (not shown), a lower internal wall (not shown), a fore internal wall 258 and an aft internal wall 259. These four internal walls bound a recess 250 in the upstanding fin body 212 which runs for its entire depth (i.e. inboard to outboard).

Two translucent graphic bearing faces 222, 226 bound the recess 250. Translucent graphic bearing face 222 is arranged such that the external surface 224 of translucent graphic bearing face 222 is flush with the inboard face 214 of the upstanding fin body 212 and translucent graphic bearing face 226 is arranged such that the external surface 228 of translucent graphic bearing face 226 is flush with the outboard face 215 of the upstanding fin body. The translucent, graphic bearing faces 222, 226 are mounted directly to the upstanding fin body 212 by screws 223, allowing removal and replacement of the faces 222, 226.

Fours arrays 240 of LEDs are mounted within the recess 250 and are arranged to illuminate both translucent graphic bearing faces 222, 226. The power connection arrangement is not show, but again, is similar to that of the first embodiment.

FIG. 7 is a section through the upstanding fin body 12 of the wingtip fin 10 of FIG. 1, looking downwardly from above the wingtip. The section is taken approximately at line III-III in FIG. 1 in a similar fashion to FIG. 6. Upstanding fin body 312 has four internal walls, an upper internal wall (not shown), a lower internal wall (not shown), a fore internal wall 358 and an aft internal wall 359. These four internal walls bound a recess 350 in the upstanding fin body 312 which runs for its entire depth (i.e. inboard to outboard). The fore and aft internal walls 358, 359, are concave in section, that is running from inboard face 314 to outboard face 316, such that recess 350 has a greater length at its central axis compared to at the inboard and outboard limits.

Two translucent graphic bearing faces 322, 326 bound the recess 350. Translucent graphic bearing face 322 is arranged such that the external surface 324 of translucent graphic bearing face 322 is flush with the inboard face 314 of the upstanding fin body 312 and translucent graphic bearing face 326 is arranged such that the external surface 328 of translucent graphic bearing face 326 is flush with the outboard face 315 of the upstanding fin body. The translucent, graphic bearing faces 322, 326 are mounted directly to the upstanding fin body 312 by screws 323, allowing removal and replacement of the faces 322, 326.

Two arrays 340 of LEDs are mounted within the recess 350 and are arranged towards the fore and aft extents of the recess 350, to illuminate both translucent graphic bearing faces 322, 326. The power connection arrangement is not show, but again, is similar to that of the first embodiment. Again, the inner surfaces of walls 358, 359 are reflective to reflect light from arrays 340 through the faces 322, 326.

Although in the drawings, the recesses and sign assemblies are drawn with straight lines and symmetrical layouts, it should be obvious to those skilled in the art that the arrangements within a wingtip fin will necessarily involve complex curvatures and tapering sections. Also, although the drawings and their description have detailed the arrangement for a right-hand wing, it will be appreciated that the present invention is equally suited to a left-hand wing also. Also, other lighting arrangements may be provided, such as fluorescent tubes or halogen lighting as appropriate. The bayonet power connection can be replaced by a spring loaded contact or other suitable power connection.

In all of the embodiments, the level of light intensity and where multicolour LED's are used, the colour of light, is controlled by a control unit which may be on board the sign assembly, in the wing or on the fuselage. The control may pass signals to the sign assembly wirelessly.

The invention claimed is:

1. A wingtip fin of an aircraft comprising an upstanding fin body, the fin body having an inboard face and an outboard face, a sign assembly in the fin body, the assembly comprising a translucent, graphic bearing face, substantially flush with and forming at least part of the inboard face or the outboard face of the fin body, a recess in the fin body behind the graphic-bearing face, and a light source arranged in the recess to illuminate the graphic-bearing face from inside the fin body.

2. The wingtip fin of claim 1, further comprising a heat sink.

3. The wingtip fin of claim 1, in which the translucent graphic bearing face is mounted to the sign assembly by a mechanical fastener.

4. The wingtip fin of claim 1, in which the translucent graphic bearing face is mounted to the sign assembly by an adhesive.

5. The wingtip fin of claim 1, in which the translucent graphic bearing face is mounted to the sign assembly by an integral moulding.

6. The wingtip fin of claim 1 in which the light source comprises an array of Light Emitting Diodes (LEDs).

7. The wingtip fin of claim 6 in which an image is borne on the translucent graphic bearing face and the array of Light Emitting Diodes (LEDs) are arranged at predetermined angles and have predetermined input intensities to provide the illumination of the image borne on the translucent graphic bearing face.

8. The wingtip fin of claim 1, in which the light source comprises one or more fluorescent tubes.

9. The wingtip fin of claim 1, in which the light source transmits low intensity light.

10. The wingtip fin of claim 1, in which the wingtip fin is of modular design, having an umbilical cord electrical connection to facilitate external access, removal and replacement of the wingtip fin.

11. The wingtip fin of claim 1, in which the sign assembly is of modular design, having an umbilical cord electrical connection to facilitate external access, removal and replacement of the sign assembly.

12. The wingtip fin of claim 1, in which an additional power cord is provided.

13. The wingtip fin of claim 1, wherein the translucent graphic bearing face is a first translucent graphic bearing face, wherein the sign assembly comprises a second translucent graphic bearing face, wherein the first translucent graphic bearing face is on one side of the fin body and the second translucent graphic bearing face is on the other opposite side of the fin body, visible from an outside the fin body, such that the first and second translucent graphic bearing faces respectively form at least part of the inboard face of the fin and the outboard face of the fin, wherein the light source is arranged between the first and second translucent graphic bearing faces.

14. The wingtip fin of claim 1, in which the level of illumination of the graphic-bearing face is automatically controlled through a control system.

15. An illuminated sign assembly configured to be received within a recess in a wingtip fin of an aircraft, the sign assembly comprising a housing, the housing containing a light source, the light source being covered by a wall of the housing, the wall of the housing being translucent and being arranged to receive a sign, the housing including an electrical power input connector for connection to an aircraft electrical power cable for powering the light source.

16. The illuminated sign assembly of claim 15, further comprising a heat sink.

17. The illuminated sign assembly of claim 15, in which the light source comprises one or more fluorescent tubes.

18. The illuminated sign assembly of claim 15, in which the light source transmits low intensity light.

* * * * *